US007929900B1

(12) United States Patent
Li et al.

(10) Patent No.: US 7,929,900 B1
(45) Date of Patent: Apr. 19, 2011

(54) WASTE TONER CARTRIDGE

(75) Inventors: Kuan-Tung Li, Taichung County (TW); Han-Ju Wu, Taichung County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 0 days.

(21) Appl. No.: 12/729,602

(22) Filed: Mar. 23, 2010

(51) Int. Cl.
*G03G 21/12* (2006.01)

(52) U.S. Cl. ..... 399/360; 399/120

(58) Field of Classification Search ..... 399/107, 399/110, 120, 358, 360
See application file for complete search history.

(56) References Cited

U.S. PATENT DOCUMENTS 5,349,425 A * 9/1994 Kamijo et al. ..... 399/120
2007/0196149 A1 * 8/2007 Sato et al. ..... 399/360
* cited by examiner

*Primary Examiner* — David P Porta
*Assistant Examiner* — Benjamin Schmitt
(74) *Attorney, Agent, or Firm* — Muncy, Giessler, Olds & Lowe, PLLC

(57) ABSTRACT

A waste toner cartridge includes a housing and a plug. The housing has a recessed bottom wall and a periphery wall integrally connected with the bottom wall to define an accommodation recess therebetween and provided with a flange having an arc section and two restricting portions respectively extending from two ends of the arc section. The plug has a body portion received in the accommodation recess, and an anchor portion extending axially from the body portion. The body portion of the plug has an outer diameter larger than a distance between the restricting sections of the flange, and the anchor portion of the plug has a radius larger than a radius of curvature of the arc section of the flange such that the plug can be firmly retained in the accommodation recess of the housing when the plug is not in use.

4 Claims, 5 Drawing Sheets

WASTE TONER CARTRIDGE

BACKGROUND OF THE INVENTION

1. Field of the Invention

The present invention relates generally to a waste toner cartridge, and more specifically to a waste toner cartridge that can firmly hold thereon a plug, which is to be used to seal an entrance of the cartridge, thereby preventing an accident separation of the plug from the cartridge when the plug is not in use and stowed on the cartridge.

2. Description of the Related Art

FIG. 1 shows a conventional waste toner cartridge 10 for use in an image forming apparatus, comprising a housing 12 and a plurality of plugs 14. The housing 12 includes a plurality of U-shaped recesses 124 each defined by a bottom wall 16 and a U-shaped periphery wall 18 having a flange 182 with an arc section 184 and two straight sections 186 respectively extending from two ends of the arc section 184. Each of the plugs 14 has a head portion 142 and a body portion 144 axially extending from the head portion 142 and received in one of the U-shaped recesses 124 and abutted against the flange 182, as shown in FIG. 2. When waste toner is collected in the waste toner cartridge 10, the plugs 14 can be removed from the U-shaped recesses 124 and then respectively plugged into entrances 126 of the waste toner cartridge 10 to close the waste toner cartridge 10.

As shown in FIG. 2, because the body portion 144 of the plug 14 has an outer diameter smaller than a distance defined by the straight sections 186 of the flange 182, the plug 14 may come off through an open end of the U-shaped recess 124; and further, because the body portion 144 of the plug 14 has a radius approximately equal to a radius of curvature of the arc section 184 of the flange 182, the plug 14 may easily drop out of the U-shaped recess 124 along a direction perpendicular to the bottom wall 16. Under this circumstance, a user usually uses a tape to retain the plugs 14 in the U-shaped recesses 124. As a result, the user has to peel off the tape before taking the plugs 14 out of the U-shaped recesses 124, causing inconvenience to the user when using the waste toner cartridge 10.

SUMMARY OF THE INVENTION

It is one objective of the present invention to provide a waste toner cartridge, which allows a plug to be assembled thereon securely and detached therefrom conveniently.

The waste toner cartridge provided by the present invention comprises a housing and a plug. The housing has a first lateral wall, a second lateral wall adjoined with the first lateral wall, a bottom wall recessed from the first lateral wall and adjoined with the second lateral wall, and a periphery wall integrally connected with the first lateral wall and the bottom wall so as to define an accommodation recess between the bottom wall and the periphery wall. The periphery wall has a flange protruding toward the accommodation recess and provided with an arc section and two restricting sections respectively extending from two ends of the arc section. The plug has a head portion, a body portion axially extending from the head portion and received in the accommodation recess of the housing and located near the arc section of the flange of the periphery wall of the housing, and an anchor portion axially extending from a distal end of the body portion. The body portion of the plug has an outer diameter larger than a distance defined between the restricting sections of the flange of the periphery wall of the housing for preventing separation of the plug from the accommodation recess of the housing along a direction parallel to the restricting sections of the flange, and the anchor portion of the plug has a radius larger than a radius of curvature of the arc section of the flange of the periphery wall of the housing for preventing disengagement of the plug from the accommodation recess of the housing along a direction perpendicular to the bottom wall.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
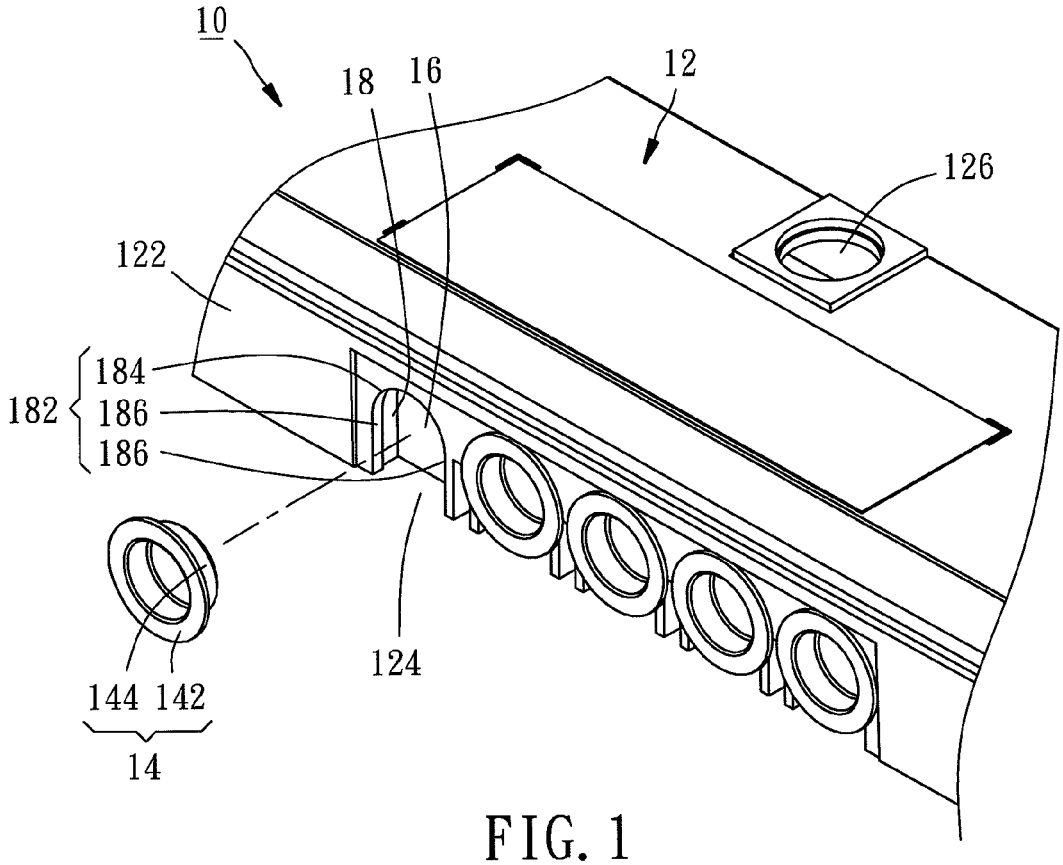
FIG. 1 PRIOR ART
FIG. 1 is a partial exploded view of a waste toner cartridge according to a prior art.
Figure 2:
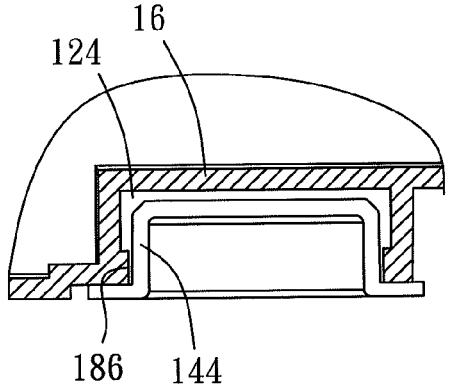
FIG. 2 PRIOR ART
FIG. 2 is a partial sectional view of the waste toner cartridge according to the prior art.
Figure 3:
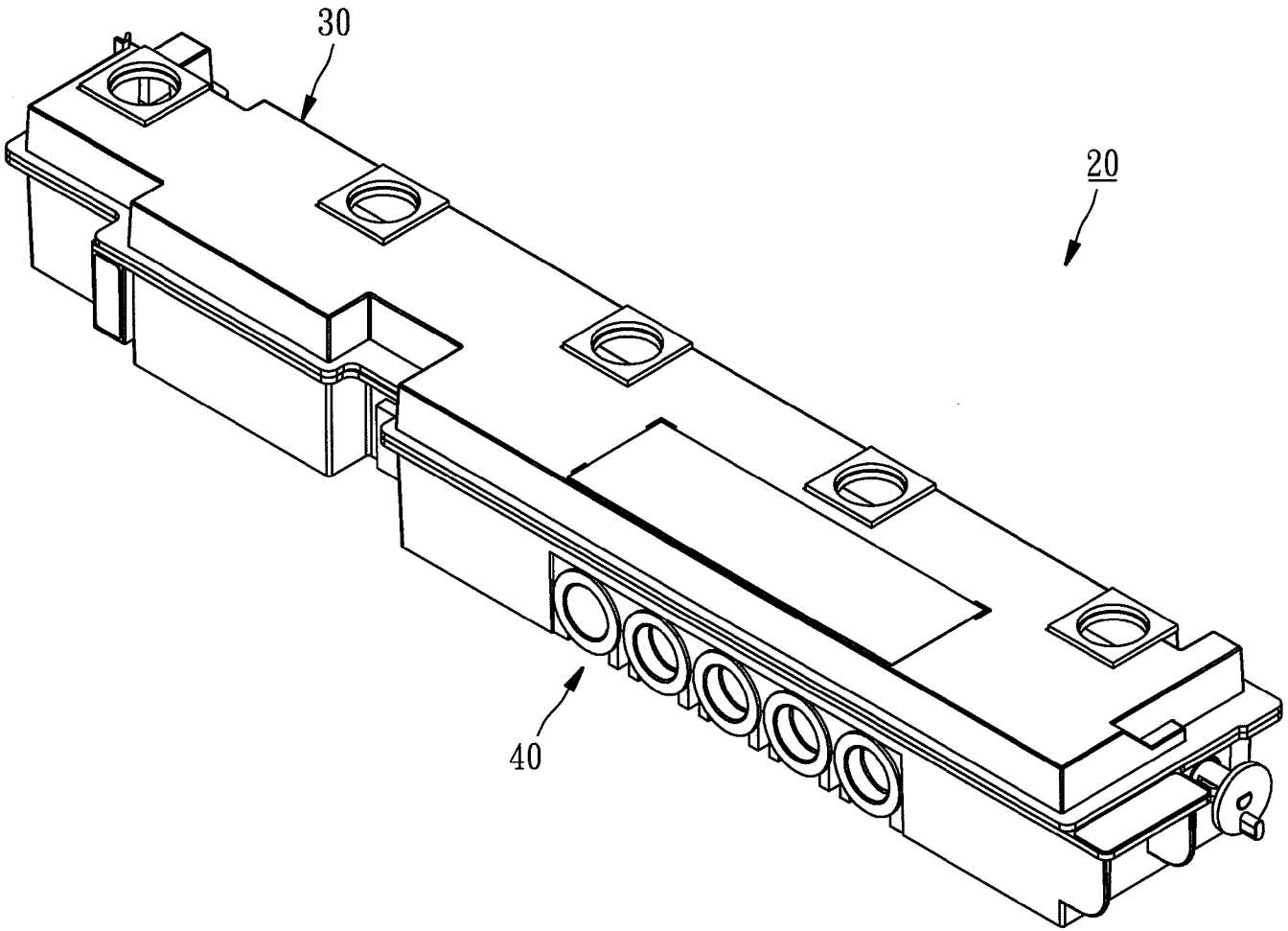
FIG. 3 is a perspective view of a waste toner cartridge according to a preferred embodiment of the prevent invention.

As shown in FIG. 3, a waste toner cartridge 20 in accordance with a preferred embodiment of the present invention is used in cooperation with an image forming apparatus (not shown), comprising a housing 30 and a plurality of plugs 40.

Figure 4:
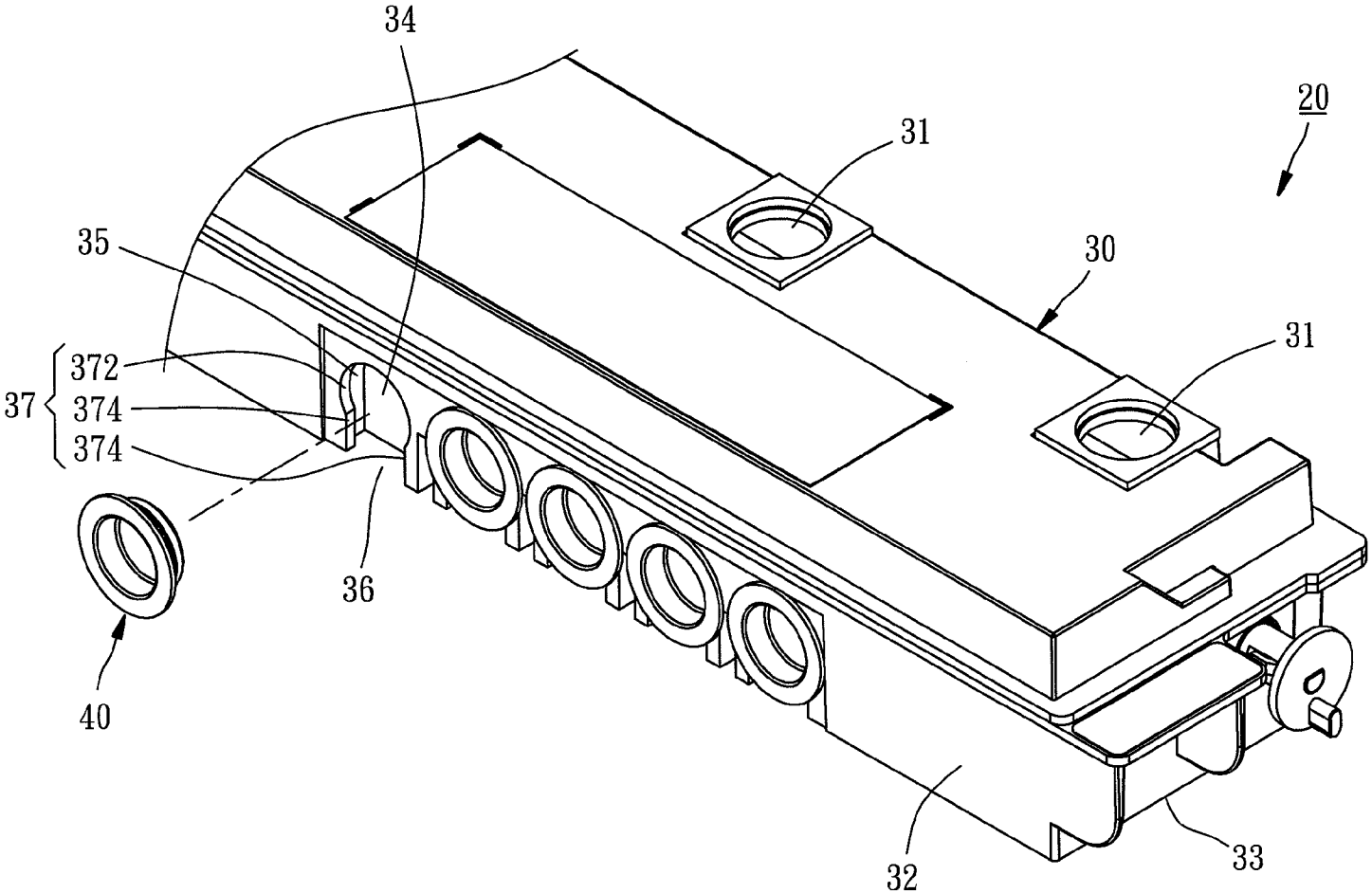
FIG. 4 is a partial exploded view of the waste toner cartridge according to the preferred embodiment of the prevent invention.
Figure 5:
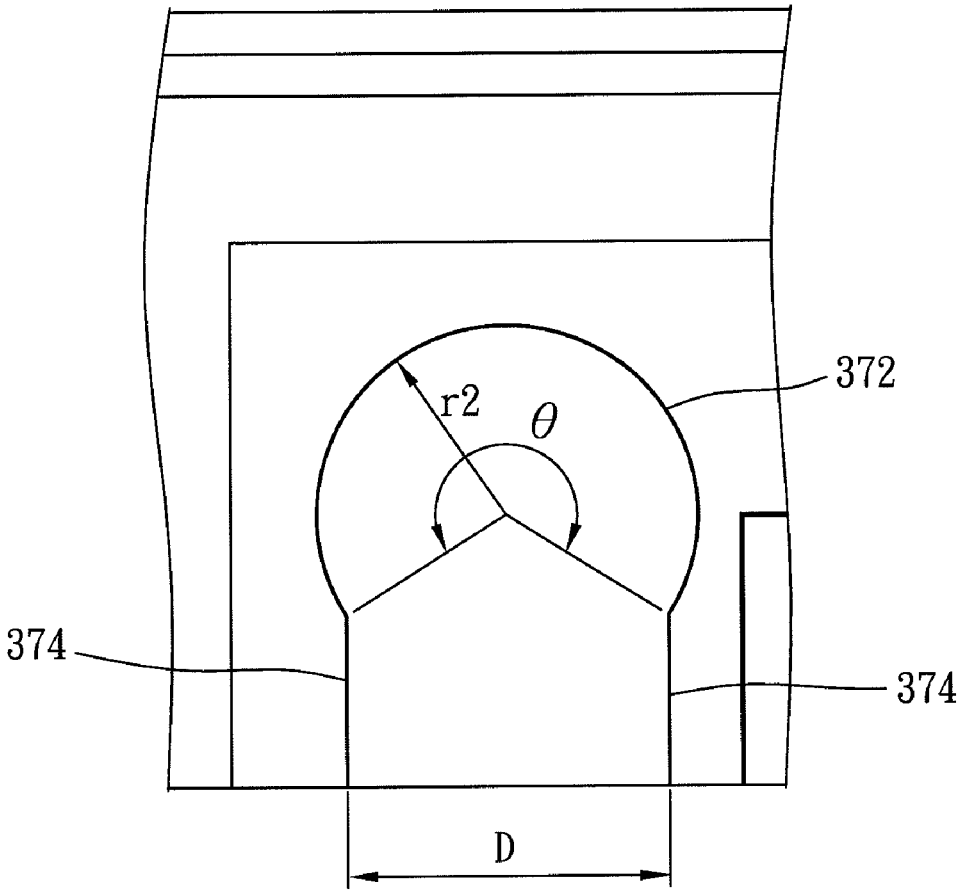
FIG. 5 is an enlarged plan view of a part of the housing of the waste toner cartridge according to the preferred embodiment of the prevent invention, showing the accommodation recess of the housing.
Figure 6:
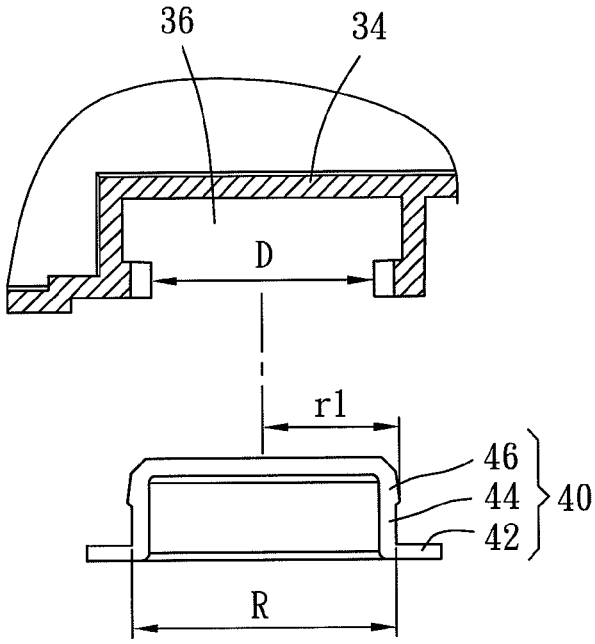
FIG. 6 is a partial sectional exploded view of the waste toner cartridge according to the preferred embodiment of the prevent invention, showing the plug isn't assembled with the housing.
Figure 7:
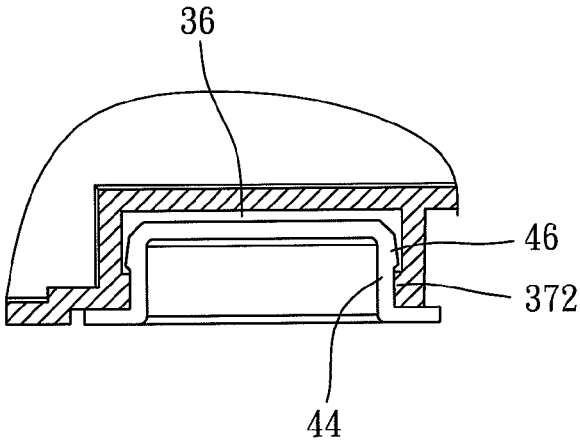
FIG. 7 is a partial sectional view of the waste toner cartridge according to the preferred embodiment of the prevent invention, showing the plug is assembled with the housing.

Referring to FIGS. 4 and 5, the housing 30 has a plurality of entrances 31 to allow the passage of waste toner such that the waste toner can be collected in the housing 30, a first lateral wall 32, a second lateral wall 33 adjoined with the first lateral wall 32, a bottom wall 34 recessed from the first lateral wall 32 and adjoined with the second lateral wall 33, and a periphery wall 35 integrally connected with the first lateral wall 32 and the bottom wall 34 so as to define an accommodation recess 36 between the bottom wall 34 and the periphery wall 35. The periphery wall 35 has a flange 37 protruding toward the accommodation recess 36 and provided with an arc section 372 defining a central angle θ larger than 180 degrees, and two restricting sections 374 parallel to each other and respectively extending from two ends of the arc section 372 in a straight manner.

Referring to FIGS. 4-7, each of the plugs 40 has a head portion 42, a body portion 44 axially extending from the head portion 42 and received in the accommodation recess 36 of the housing 30 and located near the arc section 372 of the flange 37 of the periphery wall 35 of the housing 30, and an anchor portion 46 axially extending from a distal end of the body portion 44. The body portion 44 of the plug 40 has an outer diameter R larger than a distance D defined between the restricting sections 374 of the flange 37, and the anchor portion 46 of the plug 40 has a radius r1 larger than a radius r2 of curvature of the arc section 372 of the flange 37.

As shown in FIGS. 4-7, since the radius r1 of the anchor portion 46 of the plug 40 is larger than the radius r2 of curvature of the arc section 372 of the flange 37, a user needs to apply a force to cause sufficient deformation of the anchor portion 46 of the plug 40 to allow the anchor portion 46 of the plug 40 to pass through the arc section 372 of the flange 37 when the plug 40 is assembled with the housing 30. Once the anchor portion 46 of the plug 40 passes through the arc section 372 of the flange 37, the anchor portion 46 of the plug 40 will be rebounded to its original form to engage with the arc section 372 of the flange 37, and therefore the plug 40 can't drop out of the accommodation recess 36 of the cartridge recess 30 along a direction perpendicular to the bottom wall 34 after the plug 40 is assembled with the housing 30.

Besides, since the outer diameter R of the body portion 44 of the plug 40 is larger than a distance D defined between the restricting sections 374 of the flange 37, the plug 40 can't drop out of the accommodation recess 36 through an open end of the accommodation recess 36 such that the user needs to apply a force to cause enough deformation of the body portion 44 of the plug 40 to enable the body portion 44 of the plug 40 to pass through the restricting sections 374 of the flange 37 when the user want to take the plug 40 out of the accommodation recess 36. After the plug 40 has been removed from the accommodation recess 36 of the housing 30, it can be plugged into one of the entrances 31 of the housing 30 for closing the housing 30.

By means of the aforesaid design, the waste toner cartridge of the present invention can allow the plug to be assembled thereon securely and detached therefrom conveniently without using a tape, thereby attaining the purpose of enhancing convenience of using the waste toner cartridge of the present invention.

The waste toner cartridge can be made with various kinds of design on the basis of the spirit of the present invention. For example, the restricting sections of the flange can be designed to be parallel or non-parallel to each other and extend in a straight or non-straight manner as long as the shortest distance defined between the restricting sections of the flange is smaller than the outer diameter of the body portion of the plug.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A waste toner cartridge comprising:

a housing having a first lateral wall, a second lateral wall adjoined with the first lateral wall, a bottom wall recessed from the first lateral wall and adjoined with the second lateral wall, and a periphery wall integrally connected with the first lateral wall and the bottom wall so as to define an accommodation recess between the bottom wall and the periphery wall; said periphery wall having a flange protruding toward the accommodation recess and provided with an arc section and two restricting sections respectively extending from two ends of the arc section; and a plug having a head portion, a body portion axially extending from the head portion and received in the accommodation recess of the housing and located near the arc section of the flange of the periphery wall of the housing, and an anchor portion axially extending from a distal end of the body portion;

wherein the body portion of the plug has an outer diameter larger than a distance defined between the restricting sections of the flange of the periphery wall of the housing, and the anchor portion of the plug has a radius larger than a radius of curvature of the arc section of the flange of the periphery wall of the housing.

2. The waste toner cartridge as claimed in claim 1, wherein the arc section of the flange of the periphery wall of the housing has a central angle larger than 180 degrees.

3. The waste toner cartridge as claimed in claim 1, wherein the restricting sections of the flange of the periphery wall of the housing are parallel to each other.

4. The waste toner cartridge as claimed in claim 1, wherein the restricting sections of the flange of the periphery wall of the housing extend in a straight manner.

* * * * *